United States Patent [19]

Dubost

[11] Patent Number: 4,840,683

[45] Date of Patent: Jun. 20, 1989

[54] AL-CU-LI-MG ALLOYS WITH VERY HIGH SPECIFIC MECHANICAL STRENGTH

[75] Inventor: Bruno Dubost, St. Egreve, France

[73] Assignee: Cegedur Societe de Transformation de l'Aluminium Pechiney, Paris, France

[21] Appl. No.: 158,048

[22] Filed: Feb. 16, 1988

Related U.S. Application Data

[63] Continuation of Ser. No. 710,699, Mar. 11, 1985, abandoned.

[30] Foreign Application Priority Data

Mar. 15, 1984 [FR] France ..... 84 04483

[51] Int. Cl.[4] ..... C22F 1/04

[52] U.S. Cl. ..... 148/12.7 A; 148/159; 148/417

[58] Field of Search ..... 420/533; 148/11.5 A, 148/12.7 A, 159, 417, 439, 2

[56] References Cited

U.S. PATENT DOCUMENTS

| | | | |
|---|---|---|---|
| 4,526,630 | 7/1985 | Field | 148/159 |
| 4,603,029 | 7/1986 | Quist et al. | 148/417 |
| 4,735,774 | 4/1988 | Narayanan et al. | 148/417 |

*Primary Examiner*—R. Dean

*Attorney, Agent, or Firm*—Dennison, Meserole, Pollack & Scheiner

[57] ABSTRACT

The invention relates to aluminum based alloys essentially containing Cu, Li and Mg, which have very high specific mechanical strength and can be used particularly to obtain heat treated articles of complex shapes. The analyses are as follows (as % by weight): Cu 2.4 to 3.5%, Li 1.9 to 2.7%; Mg from 0 to 0.8%; and up to: 0.20% Fe; 0.10% Si; 1% Mn; 0.30% Cr; 0.2% Zr; 0.1% Ti 0.02% Be preferably with the following limitation: $4.8 \leqq \%\ Cu + \%\ Li + \%\ (Mg/2) \leqq 6.0$. In the treated state the alloys have very high specific mechanical strength (Vickers hardness/density>70), even in the absence of any plastic deformation between quench and temper, thus justifying their use inter alia for components of complex shapes such as cast or stamped parts.

18 Claims, No Drawings

AL-CU-LI-MG ALLOYS WITH VERY HIGH SPECIFIC MECHANICAL STRENGTH

This is a continuation of co-pending application Ser. No. 710,699 filed on Mar. 11, 1985, abandoned.

The invention relates to aluminium based alloys essentially containing Cu, Li and Mg, which have very high specific mechanical strength and can be used particularly to obtain heat treated articles of complex shapes.

It is known to metallurgists that the addition of lithium reduces the density (by 3% per % by weight of lithium) and increases the modulus of elasticity and mechanical strength of aluminium alloys. This explains the interest shown by research workers in these alloys with a view of applications in the aircraft industry, which requires alloys with the highest possible specific mechanical strength (ratio of mechanical strength to density) and the highest possible specific modulus, provided that the alloys also have acceptable ductility (elongation on rupture) and toughness.

Binary alloys of aluminium with lithium are known to have insufficient mechanical strength and a ductility which precludes their use for aeronautical applications. Metallurgists have therefore resorted to adding copper. The well-known effect of copper on the structural hardening of aluminium alloys is better than that of lithium and can be superposed on the latter to give Al-Li-Cu alloys of high mechanical strength which are more ductile but also denser than binary alloys with lithium.

The particular alloys involved are American alloy 2020, where the nominal formulation is Al - 4.5%, Cu - 1.2%, Li - 0.2%, Cd - 0.5% Mn, and Soviet alloy VAD 93, where the nominal formulation is Al - 5.4%, Cu - 1.2%, Li - 0.2%, Cd - 0.6% Mn. When these are used in state T651 (quench - 2% controlled elongation - temper to maximum mechanical strength) they show very high levels of mechanical strength (particularly alloy VAD 93). However, even small additions of lithium appear to cause an appreciable loss of ductility and tensile strength, without allowing any significant lightening of the structural aircraft components, considering that they are hardly any less dense than conventional alloys without lithium.

More recently, metallurgists have proposed a new experimental alloy where the nominal formulation is Al - 3% Li - 2% Cu - 0.2% Zr (with high strength, low density and low ductility), and new alloys of the aluminium-lithium-copper-megnesium system with average strength, low density and improved ductility. The particular alloy in question has an average formulation Al - 2.4% Li - 1.25% Cu - 0.75% Mg-( Cr, Mn, Zr, Ni) and is the subject of European patent application no. 0088511 in the name of the Secretary of Defense of the United Kingdom.

Now it may be found that none of the above-mentioned known low density lithium alloys (apart from alloys VAD 93 and 2020 which are very rich in copper) has levels of mechanical strength equivalent to those of the conventional aluminium alloys which are the strongest at present (7075-T6, 7010-T 736), unless the products are subjected to cold working by about 2 to 4% plastic deformation between quenching and tempering to maximum hardness. The favourable effect to the cold working on yield strength, tensile strength and even ductility is well known to metallurgists.

This explains the relatively large number of results recently obtained with thick or thin sheets and drawn products made from Al—Li—Cu, Al—Li—Mg and Al—Li—Cu—Mg alloys in state T-651; the manufacturing process for these products must necessarily include 2 to 4% controlled elongation between quenching and tempering, so as to enable the alloys to obtain optimum levels for their mechanical properties.

This peculiarity of known lithium alloys obviously seriously restricts the use of aluminium-lithium alloys of high specific mechanical strength in the manufacture of articles of complex geometry, such as stamped articles or moulded products, where it is generally impossible to effect plastic deformation, even through controlled compression, between quenching and tempering.

The invention described below provides new lithium alloys which are free from these limitations. The alloys give products of any configuration very good mechanical properties in state T6 (equivalent to those of alloys 7075-T 6 and 7010-T 736) combined with 6 to 9% lower density as compared with conventional series 2000 or 7000 alloys. *A fortiori,* products made from alloys according to the invention have a specific mechanical strengh which is further improved by cold working between quenching and tempering (states T-651, T-652 or T-8), although this plastic deformation operation may be limited e.g. to stress relieving or planishing of the quenched products.

In the course of metallurgical experiments we have found and tested new formulations for industrial alloys of Al—Li—Cu—Mg+(Cr, Mn, Zr, Ti) system, which are stronger and perform better than known lithium alloys, from the point of view of achieveing a comprise between mechanical strength and density.

The alloys according to the invention are of the following composition by weight:

Cu from 2.4 to 3.5%
Li from 1.9 to 2.7%
Mg from 0 to 0.8%
Fe <0.20%
Si <0.10%
Cr from 0 to 0.30%
Zr from 0 to 0.20%
Ti from 0 to 0.10%
Mn from 0 to 1%
Be from 0 to 0.02%
other substances (impurities)
each <0.05%
Total <0.15%
Remainder Al.

The optimum formulations, taken individually or in combination, are as follows:

Cu from 2.5 to 3.1% (and preferably from 2.6 to 3%)
Mg from 0 to 0.5% (and preferably from 0.1 to 0.5%)
Zr from 0.07 to 0.15%
Fe less than 0.10%
Si les than 0.06%

These alloys have been found to have optimum properties when the following relationship obtains:

$$4.8 \leqq \%\ Cu + \%\ Li + \%\ Mg/2 \leqq 6.0$$

and preferably when the following obtains:

$$5.0 \leqq \%\ Cu + \%\ Li + \%\ Mg/2 \leqq 5.8$$

For values below 4.8 (or 5.0) a marked loss of strength properties is observed, and for values over 5.8 (or 6) a marked loss of ductility.

The alloys of the invention show their optimum level of strength and ductility after treatments to homogenise the cast products and to solution anneal the wrought products, including at least one stage at a temperature $\theta_H$ of from 520° to 545° C., lasting long enough either completely to dissolve the intermetallic constituents of the phases rich in Cu and Li or to obtain a size smaller than 5 μm. The optimum times for homogenising heat treatment at temperture $\theta_H$ were from 0.5 to 8 hours for alloys prepared by rapid solidification (atomisation - splat cooling) and 12 to 72 hours for products which were moulded or prepared by semi-continuous casting. In the latter case it is preferable to include one or two intermediate stages lasting a few hours at about 500° C., 515° C. or 528° C. during homogenisation or solution anneal, so as to avoid incipient fusion of the alloy when it is kept at temperature $\theta_H$.

Moreover tests on the kinetics of tempering have shown the alloys to have optimum mechanical properties after tempering times of 8 hours to 48 hours at temperatures ranging from 170° to 220° C. (preferably from 190° to 200° C.). They also show that it is preferable for appropriately shaped products (sheets, bars and billets) to be cold worked, giving rise to 1.5 to 5% (preferably 2 to 4%) plastic deformation between quenching and tempering, since this further improves the compromise obtained between mechanical strength and ductility in these alloys.

Under these conditions we found that the alloys of the invention in state T-6(51) have mechanical strength equivalent to that of alloys 7075 or 7010 T-6(51). These high levels of yield strength and tensile strength (equivalent to those of the best existing alloys for these states of heat treatment) are moreover combined with densities 6 to 8% lower than those of conventional aluminium alloys for aircraft (without lithium), and combined with satisfactory levels of ductility or elongation. This shows the importance of the alloys of the invention for manufacturing wrought or cast structural components with very high specific mechanical strength and good dynamic properties (toughness strength, resistance to fatigue), whether the products are prepared by semi-continuous coating, atomisation or splat cooling.

The invention will be understood better from the following examples, which compare the specific mechanical properties of various alloys according to the invention and outside the invention with known alloys.

EXAMPLE 1

Small ingots of the composition given in table Ia are prepared from refined aluminium (Al 99.99%), made finer by the addition of 0.15% of AT5B, then cast into moulds with a structure similar to that obtained by semi-continuous industrial casting.

All the alloys contain less than 0.02% (by weight) of Fe and less than 0.02% of Si.

The alloys are homogenised under conditions which enable the intermetallic compounds rich in lithium and copper to be virtually completely dissolved, and are quenched with water at 20° C. They undergo ageing for at least 5 days and treatments lasting 24 hours at temperatures of 150°, 170°, 190° and 210° C.

Table Ib gives the heat treatments and mean Vickers hardnesses after tempering, also the maximum specific hardness of each of the alloys (ratio of Vickers hardness to density).

The results show that the new alloys according to the invention provide a compromise between mechanical strength and density better than all the other known alloys, in virtually the whole range of tempering temperatures, and even in the range of sub-tempers which are the most likely to provide the best compromise between mechanical strength and ductility.

The very high levels of specific hardness obtained after quenching and tempering (without intermediate cold working by controlled traction or compression) explain the special interest of these light alloys for components of complex shapes such as cast or stamped parts.

EXAMPLE 2

The alloys of the composition set out in table IIa are cast semi-continuously in the form of billets 200 mm in diameter. The billets are homogenised at 515° C. for 16 hours+24 hours at 535° C., scalped and extruded into sections 50 x 20 mm at 430° C. (i.e. with a extruding ratio of 12). The sections are dissolved at 539° C., quenched with water and subjected to various tempers.

The mechanical properties obtained in a longitudinal direction, at the peak of strength after appropriate tempering, are given in table IIB, where they are compared with the properties of conventional alloys 7075 and 7150 defined by the Aluminium Association.

A moderate addition of Mg will be seen to give maximum mechanical strengths, better than or equivalent to those of the hardest conventional alloys yet known (without Li). The table shows that it is preferable to keep the content of Mg to a value slightly below 0.5% in order to obtain the best mechanical properties.

TABLE Ia

CHEMICAL COMPOSITIONS

| Casting reference | Type | Composition by weight (%) Cu | Li | Mg | Zr |
|---|---|---|---|---|---|
| 1 | 2020 | 4.35 | 1.35 | — | 0.11 |
| 2 | VAD 93 | 5.05 | 1.30 | — | 0.10 |
| 3 | LIN and STARKE | 2.20 | 2.80 | — | 0.12 |
| 4 | F92 (DTDXXXA) | 1.5 | 2.35 | 0.80 | 0.15 |
| 5 | Outside invention | 3.1 | 1.9 | 1.2 | 0.12 |
| 6 | According to invention | 3.05 | 2.55 | 0.10 | 0.12 |
| 7 | According to invention | 3.45 | 2.05 | 0.48 | 0.12 |
| 8 | According to invention | 2.95 | 2.4 | 0.26 | 0.13 |
| 9 | According to invention | 3.10 | 2.55 | 0 | 0.12 |

TABLE Ib

HEAT TREATMENTS, VICKERS HARDNESSES AND SPECIFIC HARDNESSES

| Casting reference | Homogenisation | Vickers hardness (kg/mm²) 24 hours temper at: 150° C. | 170° C. | 190° C. | 210° C. | Ratio Max. hardness Density |
|---|---|---|---|---|---|---|
| 1 | 2 h 500° C. + 28 h 520° C. | 129 | 141 | 162 | 149 | 57.8 |
| 2 | 2 h 500° C. + 48 h 520° C. | 134 | 165 | 163 | 151 | 60.4 |
| 3 | 8 h 530° C. + 48 h 545° C. | 123 | 140 | 166 | 162 | 65.3 |
| 4 | 24 h 532° C. | 138 | 141 | 160 | 149 | 62.7 |
| 5 | 48 h 530° C. | 148 | 174 | 148 | 122 | 66.3 |
| 6 | 4 h 515° C. + 72 h 540° C. | 156 | 169 | 185 | 173 | 71.5 |
| 7 | 8 h 500° C. + 16 h 515° C. + 48 h 528° C. | 176 | 190 | 170 | 142 | 72.3 |
| 8 | 48 h 528° C. + | 175 | 188 | 172 | 154 | 72.6 |

TABLE Ib-continued

HEAT TREATMENTS, VICKERS HARDNESSES AND SPECIFIC HARDNESSES

| Casting reference | Homogenisation | Vickers hardness (kg/mm²) 24 hours temper at: 150° C. | 170° C. | 190° C. | 210° C. | Ratio Max. hardness Density |
|---|---|---|---|---|---|---|
| 9 | 48 h 540° C. 4 h 515° C. + 72 h 540° C. | 157 | 168 | 186 | 175 | 72.0 |

TABLE IIa

ANALYSES (% by weight)

| Alloy reference | Li | Cu | Mg | Fe | Si | Zr | Remarks |
|---|---|---|---|---|---|---|---|
| A | 2.50 | 2.90 | <0.02 | 0.02 | 0.02 | 0.11 | According to invention |
| B | 2.45 | 2.85 | 0.40 | 0.03 | 0.02 | 0.11 | According to invention |
| C | 2.50 | 2.75 | 0.55 | 0.02 | 0.02 | 0.11 | According to invention |
| D | 2.50 | 2.95 | 0.95 | 0.02 | 0.02 | 0.11 | Outside invention |

TABLE IIb

MAXIMUM MECHANICAL PROPERTIES

| Alloy no. | State | Temper | Position ++ | Mechanical properties 0,2% yield strength (MPa) | Tensile strength (MPa) | Elongation % (5 d) |
|---|---|---|---|---|---|---|
| A | T6 | 48 h/170° C. | C | 489 | 535 | 5.0 |
| A | T6 | 48 h/170° C. | E | 505 | 555 | 4.0 |
| B | T6 | 48 h/170° C. | C | 564 | 603 | 5.5 |
| B | T6 | 48 h/170° C. | E | 591 | 640 | 4.5 |
| C | T6 | 20 h/190° C. | C | 508 | 553 | 4.7 |
| C | T6 | 20 h/190° C. | E | 547 | 584 | 4.0 |
| D | T6 | 48 h/170° C. | C | 498 | 538 | 3.5 |
| D | T6 | 48 h/170° C. | E | 538 | 557 | 2.5 |
| A | T651+ | 24 h/170° C. | C | 561 | 600 | 6.5 |
| A | T651+ | 24 h/170° C. | E | 625 | 653 | 4.5 |
| B | T651+ | 12 h/190° C. | C | 575 | 600 | 5.0 |
| B | T651+ | 12 h/190° C. | E | 625 | 655 | 5.0 |
| 7075 | T651+ | — | C | 522 | 588 | 10 |
| 7150 | T651+ | — | C | 575 | 607 | 9.0 |

+2% elongation between quench and temper
++C = centre, E = edge of section

I claim:

1. A heat treated and aged aluminium based alloy of very high specific mechanical strength, consisting essentially of (as % by weight):

Cu from 2.4 to 3.5%
Li from 1.9 to 2.7%
Mg from about 0.26 to 0.8%
Fe≦0.20%
Si≦0.10%
Mn from 0 to 1%
Cr from 0 to 0.30%
Zr from 0 to 0.20%
Ti from 0 to 0.10%
Be from 0 to 0.02%
Other substances (impurities)
each<0.05%
total<0.15%
remainder Al.

2. The alloy of claim 1, characterised in that it contains from 2.5 to 3.1% Cu.

3. The alloy of claim 1 or 2, characterised in that it contains from 2 to 2.5% of Li.

4. The alloy of claim 1, characterised in that it contains from about 0.26 to 0.5% of Mg.

5. The alloy of claim 1, characterised in that:

$$4.8 \leqq \%\ Cu + \%\ Li + \%\ Mg \leqq 6.0$$

6. The alloy of claim 5, characterised in that:

$$5.0 \leqq \%\ Cu + \%\ Li + \%\ Mg \leqq 5.8$$

7. The alloy of claim 1 or 2, characterised in that it contains a maximum of 0.10% of Fe.

8. The alloy of claim 1, characterised in that it contains a maximum of 0.06% of Si.

9. The alloy of claim 1, characterised in that it contains from 0.07 to 0.15% of Zr.

10. A method of making articles from the alloy of claim 1, comprising the steps of melting homogenizing, heat transforming, optionally cold transforming, solution anneal quenching and tempering, characterised in that homogenizing and/or solution anneal are effected at from 520° to 545° C.

11. The method of claim 10, characterised in that the homogenising time must be such that the size of the particles rich in Li and in Cu is from 0 to 5 μm inclusive.

12. The method of claim 10 or 11, characterised in that homogenisation proper is preceded by stages at approximately 500°, 515° and/or 528° C. with a view to avoiding incipient fusion of the alloy.

13. The method of claim 10 or 11, characterised in that tempering is carried out within the temperture range from 170° to 220° C. for a period of 8 to 48 hours.

14. The method of claim 10 or 11, characterised in that the product undergoes 1.5 to 5% plastic deformation between quenching and tempering.

15. The method of claim 12, characterized in that tempering is carried out within the temperature range from 170° to 220° C. for a period of 8 to 48 hours.

16. The method of claim 12, characterized in that the product undergoes 1.5 to 5% plastic deformation between quenching and tempering.

17. The method of claim 13, characterized in that the product undergoes 1.5 to 5% plastic deformation between quenching and tempering.

18. The alloy of claim 2, characterized in that it contains from 2.6 to 3% Cu.

* * * * *